US005985501A

United States Patent [19]

Sato et al.

[11] Patent Number: 5,985,501

[45] Date of Patent: Nov. 16, 1999

[54] TONER FOR DEVELOPING ELECTROSTATIC CHARGE IMAGE, METHOD OF PREPARING THE TONER, DEVELOPER FOR ELECTROSTATIC CHARGE IMAGE AND IMAGE FORMATION METHOD

[75] Inventors: Shuji Sato, Sagamihara; Yasuo Matsumura, Odawara; Manabu Serizawa, Odawara; Masaaki Suwabe, Odawara; Yasuo Kadokura, Odawara; Hisao Morijiri, Odawara; Takeshi Shouji, Minamiashigara; Takahiro Mizukuchi, Minamiashigarashi; Junichi Tomonaga, Odawara; Kouichi Sugiyama, Ebina, all of Japan

[73] Assignee: Fuji Xerox Co., Ltd., Tokyo, Japan

[21] Appl. No.: 09/081,202

[22] Filed: May 19, 1998

[30] Foreign Application Priority Data

May 19, 1997 [JP] Japan ..... 9-129040

[51] Int. Cl.[6] ..... G03G 9/08

[52] U.S. Cl. ..... 430/106; 430/137

[58] Field of Search ..... 430/137, 106, 430/109, 110

[56] References Cited

U.S. PATENT DOCUMENTS 5,585,216 12/1996 Baur et al. ..... 430/110
5,604,067 2/1997 Nagai et al. ..... 430/106.6
5,800,957 9/1998 Agata et al. ..... 430/137

FOREIGN PATENT DOCUMENTS 5-142847 6/1993 Japan .
7-319205 12/1995 Japan .

*Primary Examiner*—John Goodrow
*Attorney, Agent, or Firm*—Oliff & Berridge, PLC

[57] ABSTRACT

The toner for developing an electrostatic charge image has a sharp particle size distribution, an improved cleaning property even if the toner has small particle diameter, and a stable charging property, developing property and transfer property regardless of change of environment. By use of the toner, a highly precise image may be obtained.

In a toner for developing an electrostatic charge image prepared by a wet process, the dielectric loss factor of the toner particles is 100 or less. In addition, when the toner particles are dissolved in an organic solvent and mixed with deionized water, the electrical conductance of the solution is desirably 100 ms or less and the surface tension thereof is desirably 20 mN or more. The toner may be obtained by forming agglomerated particles with stirring in a dispersion in which resin particles are dispersed to granulate; heating the toner particles to Tg or higher of the binder resin; stirring; and cleaning. With a wet process, the added stabilizing agent such as a surfactant can be removed.

22 Claims, 3 Drawing Sheets

TONER FOR DEVELOPING ELECTROSTATIC CHARGE IMAGE, METHOD OF PREPARING THE TONER, DEVELOPER FOR ELECTROSTATIC CHARGE IMAGE AND IMAGE FORMATION METHOD

BACKGROUND OF THE INVENTION

1. Field of Invention

The present invention relates to a toner used for the development of an electrostatic image formed by an electrophotographic method or an electrostatic recording method using a developer. The present invention also relates to a method of preparing the toner, a developer for electrostatic charge image using the toner, and an image formation method using the developer for electrostatic charge image.

2. Description of Related Art

Methods for visualizing image information via an electrostatic charge image, such as an electrophotographic method, are currently used in various fields. In the electrophotographic method, an electrostatic charge image is formed on a photosensitive element via a charging and an exposure process; the image is developed with a developer containing toner; and the image is visualized via a transfer process and a fixing process.

As the developer, there are two-component-type developers containing toner and carrier and one-component-type developers containing only magnetic toner or non-magnetic toner. Toner particles in both of these types of developers are generally prepared by a kneading and pulverizing method, in which a thermoplastic resin is melted and kneaded with a pigment, a charge controller and a release agent such as a wax; cooled; finely pulverized; and classified. In order to improve the flowability and cleaning property of the toner particles prepared by the kneading and pulverizing method, inorganic or organic fine particles are added to the surface of the toner particles as needed.

Toner particles prepared by known kneading and pulverizing methods generally have an amorphous shape without a homogeneous surface composition. Although the shape and surface composition of toner particles change slightly depending on the pulverizability of the materials used and conditions of the pulverizing process, it is difficult to intentionally control these elements. In addition, when toner particles are prepared using a material with a particularly high pulverizability, the particles are often pulverized more finely in the developing device due to mechanical forces such as shearing force and the shape of the toner particles is thereby altered.

As a consequence, in the two-component-type developer, the pulverized toner particles adhere to the carrier surface so that the charge deterioration of the developer is accelerated. In addition, in the one-component-type developer, the particle size distribution of toner particles is expanded such that the pulverized toner particles are scattered or the developing property is lowered based on the change in toner shape, resulting in a deteriorated image quality.

In addition, when the toner particles have an amorphous shape, even if an auxiliary agent for improving flowability is added, the flowability may be insufficient. In addition, the fine particles of the auxiliary agent for improving flowability may move to the concave portions of the amorphous toner particles and be buried therein during operation due to mechanical forces such as the shearing force. As a result, flowability of the toner decreases over time and/or the developing property, transfer property, and cleaning property are deteriorated. Furthermore, if such toner is recollected by cleaning to return to the developer, the image quality tends to be further deteriorated. In order to prevent these problems, increasing the amount of the auxiliary agent for improving flowability has been considered. However, this may involve problems in that spots on the photosensitive element may be generated and the auxiliary agent for improving flowability may be scattered.

On the other hand, in a case of a toner containing a release agent such as wax, the release agent may be exposed on the toner particle surface depending upon the combination with a thermoplastic resin. Particularly in the case of a toner combining a resin that has a high-molecular-weight component that provides the resin with elasticity and that is not easily pulverized and a vulnerable wax such as polyethylene, exposures of the vulnerable wax such as polyethylene on the toner particle surface is often observed. Although such a toner has an advantage in the releasing property at fixing or in cleaning of untransferred toner on the photosensitive element, reliability as a developer is decreased since polyethylene on the surface of the toner particles easily falls off the toner particles due to forces in the developing device such as the shearing force and transfers to the developing roll, the photosensitive element, and the carrier, etc., causing dirt.

Under such circumstances, in recent years, as a means for preparing a toner whose particle shape and surface composition are intentionally controlled, toners have been prepared extensively with a wet process. As the wet process, there are several methods that are often used, namely, a wet sphering method capable of controlling shape of toner particles, a suspension granulating method capable of controlling surface composition of toner particles, a suspension polymerization method capable of controlling even the internal composition of toner particles, and an emulsion polymerization agglomeration method. However, other wet methods have also been used.

In recent years, one of the bigger problems associated with having toner prepared by the wet process is adding a so-called surfactant or dispersing agent (which is also referred to as "stabilizing agent" hereinafter) to greater or less degrees so as to control or keep the toner particle diameter. If the above-mentioned stabilizing agent is added at the time of toner particle production, the stabilizing agent remains in the toner liquid at the time the reaction is completed. A large amount of the stabilizing agent even remains on the surface of the toner particles.

If the stabilizing agent remains in the toner, it may lower the charging and the resistance of the toner. In particular, the stabilizing agent may have a negative influence at high temperature and humidity. Thus stable developing and transfer properties of toner may not be attained. Therefore, the advantages of the wet process, in that the particle diameter distribution of the toner particles can be made sharp and a highly precise image can be realized by making toner particles having small particle size, may be damaged. In addition, pollution on the surface of the toner leads to decreases in the flowability and preservation property and to decreases in reliability. Thus, a cleaning process to remove the stabilizing agent from toner particles is conducted, particularly after toner particles are formed by a wet process.

Most of the known methods for removing stabilizing agents from toner particles involve washing the toner particles with water. However, it is impossible to completely remove the stabilizing agent adhered to the surface of toner particles by these methods. In addition, a large amount of stabilizing agent floating in a solution cannot be easily separated. In addition, the amount of water required for cleaning is huge if the stabilizing agent is decreased as much as possible. Further, such as with toner prepared by an emulsion polymerization agglomeration method, the stabilizing agent that remains inside the toner theoretically cannot be removed.

SUMMARY OF THE INVENTION

The present invention is directed to a toner for developing an electrostatic charge image, a method of preparing the toner, a developer for electrostatic charge image using the toner, and an image forming method using the developer.

The present invention may provide:

1) A toner for developing an electrostatic charge image and a method for preparing the toner, which can provide a sharp particle size distribution of toner particles, which can improve the cleaning method of toner particles having small particle size, which can attain stable charging property, developing property and transfer property under any environments, and/or which can obtain a highly concise image;
2) A developer for electrostatic charge image having a long-life which can retain one or more of the above properties;
3) An image formation method by which only small amounts of toner are consumed with a high transfer efficiency;
4) An image formation method which can provide a full-colored image having high image quality and high reliability;
5) An image formation method having high reliability in a system in which toner recollected from a cleaner can be reused (toner recycling system); and/or
6) An image formation method by which a high image quality can be obtained in a system having no cleaning mechanism (cleanerless system).

The present inventors have found that good charging property, transfer property and high image quality can be obtained by making a toner for developing an electrostatic charge image in which the amount of stabilizing agent that remains in the toner is decreased to a determined range and the dielectric property of the toner particles is maintained at a determined value or less.

The present invention comprises a toner for developing an electrostatic charge image prepared by a wet process in which toner particles are granulated in water, an organic solvent or a mixture of water and an organic solvent, wherein the dielectric loss factor of the toner particle is 100 or less.

DETAILED DESCRIPTION OF PREFERRED EMBODIMENTS

Figure 1:
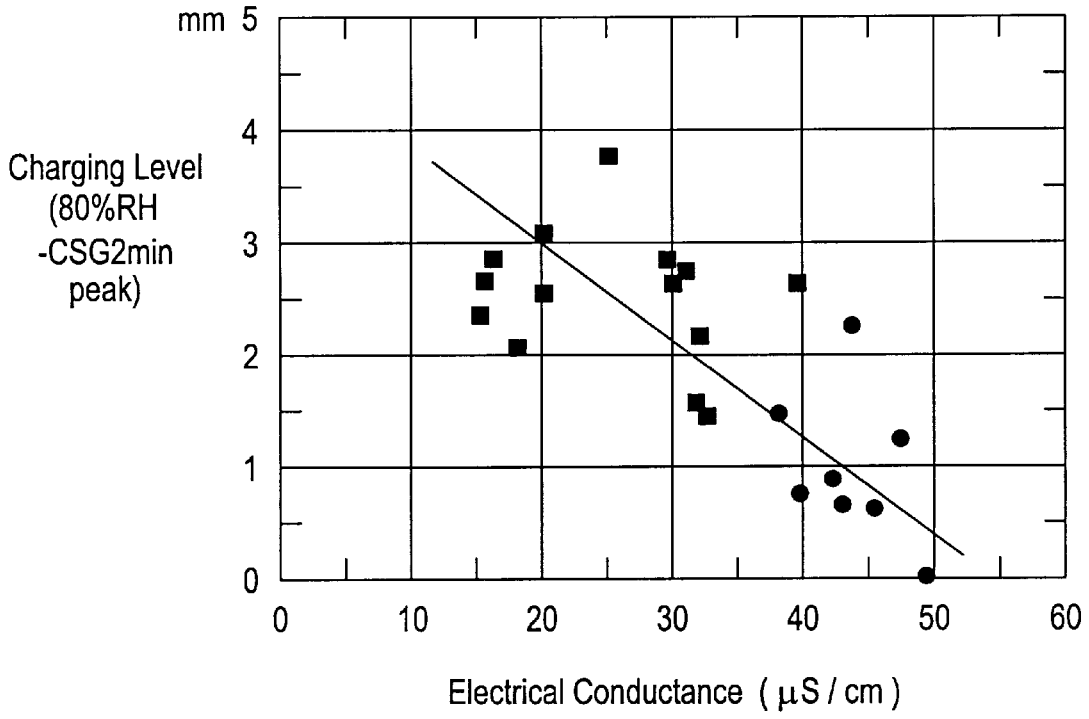
FIG. 1 is a graph showing the relationship between the electrical conductance and the charging property of the toner particles for developing an electrostatic charge image.

The degree of removing the stabilizing agent that remains in the toner can be determined by electrical conductance and surface tension of a solution when toner particles obtained by a wet process are dissolved in an organic solvent and mixed with deionized water. In the present invention, the electrical conductance and the surface tension have a standard of 100 $\mu$S or less and 20 mN or more, respectively. By heating the toner particles after granulation to the glass transition temperature (Tg) or higher of the resin constituting the toner particles, stabilizing agent remaining in the toner can be effectively removed.

It is often necessary to add a stabilizing agent to control particle size and shape and to provide stability of the toner particles in toner prepared by a wet process. A large amount of stabilizing agent remains in the toner liquid after completion of the reaction. In particular, the stabilizing agent remains on the surface of the toner. Stabilizing agents such as surfactants and the like can be removed to a certain degree by a cleaning process for toner particles after pulverizing. Although Japanese patent publication No. 7-319205-A describes a toner having an electrical conductance of 1 to 100 $\mu$S/cm in a solution obtained by adding 10 parts by weight of the toner into deionized water and stirring. In connection with cleaning with water, this reference does not recite whether stabilizing agent remains near the surface or in the inside of the toner, which has an influence on the toner properties. Although, with the toner particles, excellent charging property, dielectric property and flowing property are concretely obtained by the effect of the additives on the surface of toner initially, these properties are decreased when toner particles are deteriorated due to release of the additives from toner particles while running a machine and imbedding the additives in the concave portions on the surface of the toner.

In addition, a method in which the amount of cleaning water is further increased may be effective to resolve many of these problems. However, even with this method, it only removes the stabilizing agent that remains on the surface depending on toner structure. Thus it is insufficient to provide as good toner properties, such as charging property, developing property and transfer property for a long-period. Therefore, problems will often occur over a long period even in a toner initially having high image quality and high small line reproductivity, which are obtained by small particle diameter, narrow particle size distribution, shape and the like of toner particles obtained by a wet process. Further, increases in the amount of cleaning water strongly influences cost, and is therefore a problem.

As a method for cleaning toner prepared by a wet process, cleaning with an alkali is carried out as described in Japanese Patent Publication No. 5-142847-A, in addition to or instead of the above-mentioned cleaning with water. Although the solubility of the stabilizing agent into the cleaning water is increased with an alkali, and the expected improvement of the cleaning property is achieved, the effect of removing the stabilizing agent that remains near the surface of the toner and in the inside of the toner as described above is low.

In the present invention, in order to avoid these problems, a cleaning method is used in which after washing with water as described above, the toner particles are again dispersed in washing water, and the toner particles are heated to the glass transition temperature (Tg) of the resin of the toner particles and stirred. By this method, the electrical conductance and the surface tension of the solution, obtained by dissolving the toner particles after cleaning into an organic solvent and mixing with deionized water, can be controlled within a predetermined range.

The electrical conductance is preferably 100 $\mu$S/cm or less, further preferably 50 $\mu$S/cm or less. The surface tension of the solution is preferably 20 mN or more, more preferably 30 mN or more. When the electrical conductance is higher than the specified range (100 μS/cm) or when the surface tension is less than the specified range (20 mN), the resistance of the toner may be lower and fog and scattering may occur due to charging inferiority at high temperature and humidity, decreasing image quality. In addition, as to the dielectric property of toner, the dielectric loss factor value, which shows the current loss at the time of applying alternating field, should be kept below 100. If the dielectric loss factor exceeds 100, toner resistance is lowered having an influence specifically on the transfer property. In particular, the reliability over a long-period is deteriorated even in a system in which toner recollected in cleaning is reused and in a system which is cleanerless.

The above-mentioned toner particles for developing an electrostatic charge image may be formed by agglomerating and/or associating with stirring in a dispersion in which the resin particles and the colorant are dispersed, and granulating. Besides the resin particles and the colorant, inorganic fine particles, release agent fine particles and charge controlling agent fine particles, etc. may be added, if desired. These fine particles may be added to a resin particle dispersion as a fine particle dispersion. The fine particle dispersions may be added to the resin particle dispersion sequentially with mixing between each addition.

The method of preparing the toner for developing an electrostatic charge image of the present invention preferably comprises a first step in which agglomerated particles are formed in a dispersion, in which at least resin particles are dispersed, to prepare an agglomerated particle dispersion; a second step in which a fine particle dispersion, in which fine particles are dispersed, is added and mixed into the agglomerated particle dispersion to adhere the fine particles to the agglomerated particles to form adhered particles; and a third step in which the adhered particles are heated and fused.

The above-mentioned second step is preferably conducted a plurality of times. The second step is preferably a step in which, after adding and mixing a release agent fine particle dispersion, in which release fine particles are dispersed, into the agglomerated particle dispersion to adhere the release agent fine particles to the agglomerated particles to form adhered particles, a resin-containing fine particle dispersion, in which resin-containing fine particles are dispersed, is added and mixed to further adhere the resin-containing fine particles to the adhered particles so as to form further adhered particles.

In addition, the above second step is preferably a step in which, after adding and mixing the colorant fine particle dispersion, in which the colorant fine particles are dispersed, into an agglomerated particle dispersion of resin fine particles to adhere the colorant fine particles to the agglomerated particles so as to form adhered particles, a resin-containing fine particle dispersion, in which the resin-containing fine particles are dispersed, is added and mixed to further adhere the resin-containing fine particles to the further adhered particles so as to form further adhered particles.

Further, the second step is preferably a step in which, after adding and mixing the resin-containing fine particle dispersion, in which the resin-containing fine particles are dispersed, into an agglomerated particle dispersion to adhere the resin-containing fine particles to the agglomerated particles, an inorganic fine particle dispersion, in which inorganic fine particles are dispersed, are added and mixed to further adhere the inorganic fine particles to the adhered particles so as to form further adhered particles.

In the second step, adhered particles are formed by adding and mixing the fine particle dispersion in the agglomerated particle dispersion prepared in the first step, and adhering the fine particles on the agglomerated particles. Since the fine particles are added to the agglomerated particles, the fine particles may be referred to as "added particles" in the present invention.

The adding and mixing method of the above-mentioned fine particle dispersion is not specifically limited. For example, the procedure can be conducted gradually and continuously, or can be conducted in a plurality of stages. In either case, by adding and mixing the fine particles (added particles) in this way, generation of minute particles can be suppressed. Thus a sharp particle distribution for the toner can be ensured. By conducting the adding and mixing procedure in a plurality of stages, layers of the above-mentioned fine particles are laminated on the surface of the above-mentioned agglomerated particles in stages. Thus structure change or composition gradient can be provided from the inside to the outside of the particles of the toner. Surface hardness of the particles can be improved and the particle size distribution can be maintained by fusing in the third step, restricting the ability of the particles to be changed. Further, the addition of a stabilizing agent such as a surfactant and a base or an acid for improving the stability at fusing is not required, or the amount added thereof can be curbed to the minimum level. This may provide for cost reduction and improved quality.

For the resin particles, a thermoplastic binder resin, for example, may be used. Examples of thermoplastic binder resin polymers include polymers of monomers including styrenes, such as styrene, parachloro styrene and -methylstyrene; esters having a vinyl group, such as methyl acrylate, ethyl acrylate, n-propyl acrylate, lauryl acrylate, 2-ethyl hexyl acrylate, methyl methacrylate, ethyl methacrylate, n-propyl methacrylate, lauryl methacrylate and 2-ethyl hexyl methacrylate; vinyl nitriles, such as acrylonitrile and methacrylonitrile; vinyl ethers, such as vinyl methyl ether and vinyl isobutyl ether; vinyl ketones, such as vinyl methyl ketone, vinyl ethyl ketone, and vinyl isopropenyl ketone; olefins, such as ethylene, propylene, and butadiene; copolymers of two or more of the above monomers, or mixtures thereof. In addition, nonvinyl condensation-containing resins, such as epoxy resin, a polyester resin, a polyurethane resin, a polyamide resin, a cellulose resin, and a polyether resin; a mixture of a nonvinyl condensation-containing resin with an above vinyl-containing resin; and graft copolymers obtained by polymerizing a vinyl-containing monomer under co-existence with a nonvinyl condensation-containing resin, may also be used.

Resin particle dispersions are formed by dispersing the above resin in water to a concentration of 2 to 40% (w/w). The average particle diameter of the dispersed resin particles is preferably 1 μm or less, more preferably 0.01 to 1 μm. When the average particle diameter of the resin particles exceeds 1 μm, the particle diameter distribution of the toner may be expanded, and free particles may be produced, leading to a decrease of properties and reliability. On the other hand, if the average particle size of the resin particles is within the above range, the above deficiencies are eliminated, and toners can be spread more evenly so that the dispersion in the toner is improved. Thus it is advantageous in that irregular performance or reliability is alleviated. The average particle size may be measured with e.g., a Coulter counter.

In a case of a vinyl-containing monomer, a resin particle dispersion can be prepared by an emulsion polymerization or seed polymerization using an ionic surfactant etc. In a case of another resin, if the resin is oleaginous and can be dissolved in a solvent having a relatively low solubility in water, a resin dispersion can be prepared by dissolving the resin in the solvent, dispersing in water in the form of fine particles with an ionic surfactant or a high molecular weight electrolyte using a dispersing machine such as homogenizer, and then evaporating the solvent by heating or reducing pressure.

Examples of the colorant include pigments, such as carbon black, chrome yellow, hanza yellow, bendizine yellow, threne yellow, quinoline yellow, permanent orange GTR, pyrazolone orange, vulcan orange, watchung red, permanent red, brilliant carmine 3B, brilliant carmine 6B, Du Pont oil red, pyrazolone red, lithol red, rhodamine B lake, lake red C, rose red oxide, aniline blue, ultra marine blue, methylene blue chloride, phthalocyanine blue, phthalocyanine green, and malachite gree oxalate; and dyes, such as acridine type, xanthene type, azo type, benzoquinone type, adine type, anthraquinone type, thioindigo type, dioxadine type, thiazine type, azomethine type, indigo type, phthalocyanine type, aniline black type, polymethine type, triphenyl methane type, diphenyl methane type, thiazine type, thiazole type, and xanthene type. These colorants may be used alone or in combination of two or more.

The colorant dispersion can be prepared by adding the above colorant in water to a concentration of 2 to 40% (w/w) and dispersing with a known dispersing machine, such as a rotation shearing type homogenizer, ball mill, sand mill, or dyno mill using an ionic surfactant having the opposite polarity to the resin used. The average particle size of the colorant is preferably in the range from 0.05 to 0.50 $\mu$m using a determining machine, such as a scattering type determining machine (manufactured by HORIBA Co., Ltd.; LA700).

In the present invention, when the above resin particles and the above colorant dispersion are mixed, an internal additive may be added. As the internal additive, a metal, such as ferrite, magnetite, reduced iron, cobalt, nickel, and manganese, alloys, or magnetic substances, such as a compound containing a metal, can be used.

As a charge controlling agent, a variety of known charge controlling agents, such as a quaternary ammonium salt compound, a nigtosine-containing compound, dyes comprising a complex of aluminum, iron or chrome, and a triphenyl methane-containing pigment, may be used. However, a material is preferably used which cannot be easily dissolved in water, in order to provide increased control of the ion strength, which influences stability upon agglomeration or association, and in order to reduce waste water pollution.

In addition, when the above resin particle-containing dispersion and the above colorant-containing dispersion are mixed, a release agent particle-containing dispersion is preferably also added. Examples of the release agent include low-molecular-weight polyolefins, such as polyethylene, polypropylene and polybutene; silicones having a softening point induced by heating; aliphatic amides, such as amide oleate, amide erucate, amide recinolate, and amide stearate; plant waxes, such as carnauba wax, rice wax, canderira wax, tree wax, and jojoba oil; animal wax, such as beeswax; ore/oil waxes, such as montan wax, ozokerite, ceresin, paraffin wax, microcrystalline wax, and Fisher Tropsch wax; and denatured products thereof.

These waxes may be added as a dispersion containing particles of preferably 1 $\mu$m or less. The dispersion may be prepared by dispersing a polymeric acid and/or a polymeric base in water with a polymer electrolyte such as an ionic surfactant, heating to the melting point of the polymeric acid and/or polymeric base or higher and pulverizing with a homogenizer capable of applying a strong shearing force or a pressure-discharge-type dispenser.

The agglomerated particles are formed by mixing the above resin particles and the above colorant dispersion in a predetermined ratio, and heating to a temperature in the range of from room temperature to the glass transition temperature of the resin to agglomerate the resin particles and the colorant. The average particle size of the agglomerated fine particles is preferably in the range from 2 to 9 $\mu$m. Then, a toner particle-containing liquid (toner particle dispersion) can be obtained by heating the mixture containing the agglomerated particles to the softening point or higher of the resin, generally 70 to 120° C., so as to fuse the agglomerated particles.

Examples of the surfactant used in emulsion polymerization, seed polymerization, pigment dispersion, resin particles, release agent dispersion, agglomeration, and/or stabilization, include anionic surfactants, such as sulfate ester salt type, sulfonate type, phosphate ester type, and soap type; cationic surfactants, such as amine salt type and quartenary ammonium salt type; nonionic type surfactants, such as polyethylene glycol type, alkyl phenol ethylene oxide adduct type, and polyhydric alcohol type. The nonionic type surfactants may be effectively used in combination with the anionic or cationic surfactant. As the means for dispersion, a rotation shearing homogenizer, a ball mill, a sand mill, and a dyno mill which use media, as well as other known means, may be used.

Then, the obtained toner particle-containing liquid is cleaned with ion exchange water one to three times or more after separating toner particles by centrifuging or suction-filtration. Then after filtering off the toner particles and again dispersing in ion exchange water, the toner particles are heated to the glass transition temperature (Tg) or higher of the resin of the toner particles, and are stirred for a period of from 30 minutes to two hours. After cooling to room temperature, the toner particles are again filtered off, washed with ion exchange water one to three times or more, and dried to obtain the toner of the present invention.

When the toner particles are heated to the glass transition temperature (Tg) or higher of the resin of the toner particles, if the temperature is too high, liverations of the colorants and release agents in the toner particles may be produced and charging property and dielectric property may be deteriorated. If the temperature is less than Tg, the stabilizing agent may not be effectively extracted. As a result, preferable charging and dielectric properties may not be easily obtained. Thus the heating temperature is desirably 10 to 35° C. higher than Tg.

Further, the pH of the toner particle-containing liquid (toner particle dispersion) is desirably adjusted to 7 to 12 before heating, and is stirred. If the pH of the toner particle-containing liquid (toner particle dispersion) is less than 7, the extraction of the stabilizing agent may be insufficient, a low-charging toner may be produced, and/or the stabilizing property at a high temperature may be lowered. These problems may be more significant in a toner having a dissociation group. In addition, if the pH is higher than 12, alkalis will tend to remain, and the charging properties may be insufficient.

Further, it is also possible to add inorganic particles such as silica, alumina, titania, calcium carbonate or resin particles such as a vinyl-containing resin, polyester, and silicone, to the surface of the toner while applying a shearing force in the dry state. Such inorganic particles may be added as an auxiliary agent for improving flowability or for cleaning.

The toner shape factor average (square of perimeter/projected area) is preferably from 105 to 150. In particular, when the shape is more similar to spherical shape (real sphere), undesirable problems in practical use may occur. In particular, the removal of the stabilizing agent may be difficult by the usual cleaning of the surface with water or alkalis, the charging properties may be deteriorated, and/or the image density may be lowered. The toner for developing an electrostatic charge image of the present invention can attain a stable charging property when the toner has a shape from a sphere to an amorphous shape.

The above-mentioned toner shape factor average can be calculated, for example, as follows. An optical microscope having a slide glass on which toner is spread, is incorporated into an image analyzing device via a video camera, the square of the perimeter/projected area ($ML^2/A$) of 100 or more of the toner particles is calculated, and an average is determined to obtain the toner shape factor average.

The above-mentioned toner for developing an electrostatic charge image of the present invention has a dielectric loss factor (which is also referred to as specific dielectric loss factor) of 100 or less specifically among dielectric properties. The toners having a dielectric loss factor of 50 or less are preferably used. The dielectric loss factor shows the resistance of dielectrics placed in an alternating field. It has been known that the larger the value, the lower the resistance. The determination is carried out for example by peletting toner particles, placing the peletting toner particles between electrodes for determining dielectrics, and applying an alternating field up to 100 KHz.

The amount of the stabilizing agent remaining can be determined as follows. After dissolving toner in 1 to 10 parts by weight of an organic solvent, about 10 to 100 parts by weight of deionized water is added to the solution. Since the remaining stabilizing agent can be extracted into a water layer or an oil layer, the amount of the stabilizing agent remaining can be determined by determining the electrical conductance and surface tension of the extracted liquid. Generally known organic solvents can be used regardless of the degree of polarity.

Figure 2:
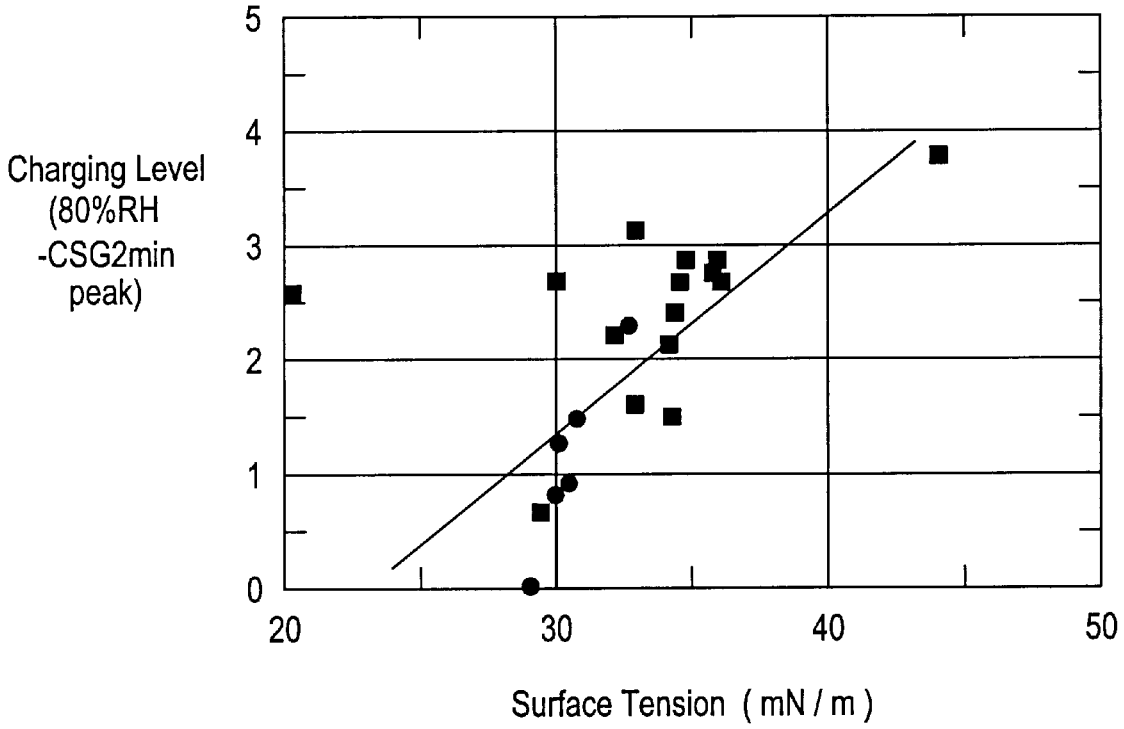
FIG. 2 is a graph showing the relationship between the surface tension and charging property of the toner particles for developing an electrostatic charge image.

The relationship of electrical conductances or surface tensions of the toner particles with the charging properties are shown in FIG. 1 and FIG. 2. The relationship of dielectric loss factors and the transfer efficiencies of the toner particles are shown in FIG. 3.

Figure 3:
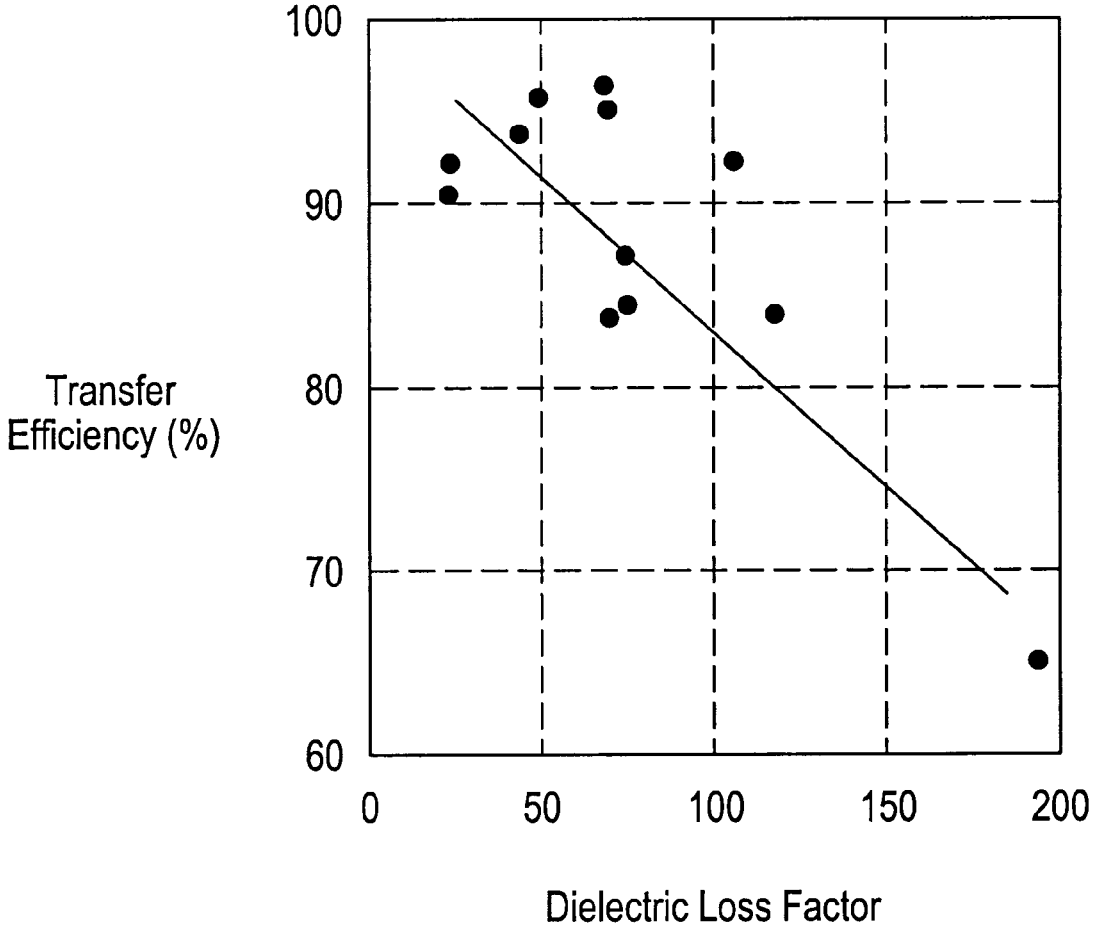
FIG. 3 is a graph showing the relationship between the dielectric loss factor and transfer efficiency of the toner particles for developing an electrostatic charge image.

In FIGS. 1 to 3, ● represents the toner particles obtained by a conventional cleaning method when the toner particles are manufactured by a wet process, and ■ represents the toner particles obtained by the cleaning method of the present invention when the toner particles are manufactured by a wet process.

The conventional cleaning method means a method in which toner particles are obtained by cleaning the toner particle dispersion with water. The cleaning method of the present invention means a method in which after washing the toner particle dispersion with water, the toner particles are again dispersed in washing water and then the toner particles are heated to Tg or higher. With regard to other conditions, these two methods are essentially the same as each other.

With the toner particles obtained by the conventional cleaning method, the dielectric loss factor of the toner is as high as 100 $\mu$S/cm or higher. However, with the toner particles obtained by the cleaning method of the present invention, the electrical conductance is within the range from about 25 to 30 $\mu$S/cm, which is lower than the toner particles obtained by the conventional cleaning method. In addition, the dielectric conductance of the toner particles obtained by the cleaning method of the present invention is about 25 or less, which is also lower than the toner particles obtained by the conventional cleaning method. Therefore, in the toner particles obtained by the cleaning method of the present invention, the stabilizing agent such as surfactant is sufficiently removed and the dielectric properties are excellent.

With the toner particles obtained by the cleaning method of the present invention, the surface tension is relatively high at about 32 to 44 mN, thus indicating that the stabilizing agent such as surfactant was sufficiently removed. The dielectric loss factor is as low as 40 or less, which shows that it is excellent in dielectric property.

As shown in FIG. 1, the toner particles obtained by a cleaning method of the present invention have a lower electrical conductance and a higher charging level than the toner particles obtained by the conventional cleaning method. In addition, as shown in FIG. 2, the toner particles obtained by the cleaning method of the present invention have a higher surface tension and a higher charging level than the toner particles obtained by the conventional cleaning method. Therefore, the results demonstrate that toner particles obtained by the cleaning method of the present invention have a higher charging property than toner particles obtained by the conventional cleaning method.

FIG. 3 demonstrates the transfer efficiency determined by Able 1302 Modifier, manufactured by Fuji Xerox Co., Ltd. As shown in FIG. 3, when the dielectric loss factor is low, the transfer efficiency is high. The term "transfer efficiency" indicates the ratio of the reflection densities of the developed image on a photoconductive body and of a non-transferred after image. The values in FIG. 3 demonstrate the transfer efficiency when the developed image density is 0.7.

Therefore, as is also clear from FIGS. 1 to 3, the toner particles obtained by the cleaning method of the present invention are excellent in dielectric property, charging property, and transfer efficiency.

A developer for electrostatic charge image can be obtained by combining the toner of the present invention and a carrier. The above-mentioned carrier is not specifically limited, and includes carriers known in the art. The mixing ratio of the toner of the present invention and the carrier in the electrostatic charge developer is not specifically limited, and can be selected according to the purpose.

The image formation method of the present invention comprises a process in which a latent image is formed on an electrostatic latent image holding member, an electrostatic latent image on the electrostatic latent image holding member is developed using an electrostatic charge image developer layer on a developer holding member, a toner image on the latent image holding member is transferred on a transfer body, and the toner remaining on the latent image holding member is removed. The image formation method is not specifically limited provided that the developer contains the toner of the present invention. Each above process step can be carried out using known image formation devices, such as copy machines and facsimiles.

The image forming method of the present invention preferably further comprises a recycling process. The above cleaning process is a process in which excess toner for developing an electrostatic charge image is recollected when a toner image is formed. The above recycling process is a process in which the toner for developing an electrostatic charge image recollected in the above cleaning process is transferred to the developer layer.

One embodiment of the image formation method which contains the cleaning process and recycling process can be carried out using an image forming machine, such as a toner-recycling-type copying machine and a facsimile machine. In addition, the method can be applied to a recycling system in which toner is recollected at the same time of developing, thus omitting the cleaning process.

EXAMPLES

The present invention will be explained hereinafter based on the following concrete examples. However, the present invention is not limited by the examples.

Example 1

Preparation of Toner Particles

- 260 g Resin Dispersion [Styrene-Butyl acrylate-Acrylic acid Copolymer (copolymerization ratio 82:18:2), Mw=23000, Tg=65]
- 39 g Pigment Dispersion (Mogul L, Cabot)
- 20 g Release agent Dispersion (HNP0190, manufactured by Nihon Seirou Co., Ltd.)
- 1.5 g Cationic Surfactant (Sanisol C, manufactured by Kao Co., Ltd.)

The above components are mixed and dispersed using Ultratalax T50 (manufactured by IKA Co., Ltd.) in a round stainless steel flask, and are then heated to 50° C. while stirring the flask in an oil-bath for heating. After maintaining the temperature at 50° C. for 60 minutes, the particle size is determined with a Coulter counter (manufactured by Coulter Co., Ltd.: Multisizer 2), and the production of agglomerated particles of about 4.5 μm is confirmed. The temperature of the oil-bath is then further increased and is kept at 52° C. for one hour. By determining the particle size, it is confirmed that agglomerated particles of about 5.0 μm are produced. Then, after adding 3 g of anionic surfactant (Neogen RK, manufactured by Daiichi Kogyo Co., Ltd.) to the dispersion containing the agglomerated particles, the stainless steel flask is sealed, and is then heated to 97° C. with continuing stirring using magnetic seal, which is maintained for four hours. After cooling, the particle diameter is determined using a Coulter counter. The determined particle diameter is 5.1 μm.

The toner particles are then filtered off from the prepared toner particle-containing liquid, and are washed with ion-exchange water three times. Then, after dispersing the toner particles in 3 L of ion-exchange water and adding 1N sodium hydroxide so as to adjust the pH to 9.5, the dispersion is again transferred to a round stainless steel flask. The dispersion is then heated to 80° C. while stirring the round stainless steel flask in an oil-bath for heating for two hours. Then the toner particles are filtered off, washed with ion-exchange water three time, dried in a vacuum for ten hours, and sieved to obtain toner having an average particle diameter of 5.2 μm.

Determination of Electrical Conductance and Surface Tension

The amount of the stabilizing agent remaining in the toner after drying is determined by electrical conductance and surface tension as described below. After dissolving 1 to 10 g of toner in 1 to 10 g of acetone and adding 10 to 100 ml of ion-exchange water, the deposits are filtered off and electrical conductance and surface tension of the solution is determined. In Example 1, the electrical conductance is 15 μS/cm and the surface tension is 50 mN.

Determination of Dielectric Loss Factor

The dielectric loss factor of the toner after drying is determined as described below.

5 g of the toner is pelleted and set between electrodes (SE-71-type electrodes for solids materials, manufactured by Ando Denki Co., Ltd.), and the dielectric loss factor is determined at 5V using a LCR meter (4274A type, manufactured by Yokogawa Hewlett-Packard Co., Ltd.). The dielectric loss factor is calculated using the following equation (1).

$$[14.39/(W\times D^2)]\times G_x\times T_x\times 10^{12} \qquad \text{Equation (1)}$$

In the formula, $W=2\pi f$(f: determined frequency 100 kHz), D: electrode diameter (cm), $G_x$: electrical conductance (S), $T_x$: sample thickness (cm).

As the result of the determination, the dielectric loss factor is 15 in Example 1.

Example 2

Toner particle-containing liquid is prepared in the same manner as described in Example 1.

The toner particles are filtered off from the prepared toner particle-containing liquid, and are washed with ion exchange water three times. After dispersing the toner particles in 3 L of ion exchange water and adding 1N sodium hydroxide to adjust the pH to 9.5, the toner particles are again transferred to a round stainless steel flask, and are heated to 70° C. while stirring the flask in an oil-bath for heating for two hours. Then the toner particles are filtered off, washed with ion exchange water three times, dried in a vacuum for ten hours, and sieved to obtain toner.

Determination of Electrical Conductance and Surface Tension

The electrical conductance and surface tension are determined in the same manner as described in Example 1. The electrical conductance is 20 μS/cm, and the surface tension is 40 mN.

Determination of Dielectric Loss Factor

The dielectric loss factor is determined in the same manner as described in Example 1. The dielectric loss factor of the toner of Example 2 is 20.

Example 3

Preparation of Toner Particles

- 210 g Resin Dispersion (Styrene-Butylacrylate-Acrylic acid copolymer, Mw=20000, Tg=60)
- 30 g Pigment Dispersion (Mogul L, Cabot)
- 20 g Release agent Dispersion (HNP0190, manufactured by Nihon Seirou Co., Ltd.)
- 1.5 g Cationic Surfactant (Sanisol C, manufactured by Kao Co., Ltd.)

The above components are mixed and dispersed with Ultratalax T50 (manufactured by IKA Co., Ltd.) in a round stainless steel flask, and were then heated to 50° C. while stirring the flask in an oil-bath for heating. After maintaining at a temperature of 48° C. for 60 minutes, the particle size is determined with a Coulter counter. It is confirmed that agglomerated particles of about 4.0 μm are produced. After adding 50 g of the resin dispersion, the temperature of the oil-bath for heating is further increased to 51° C. for one hour. By determining the particle size, it is confirmed that agglomerated particles of about 5.2 μm are produced.

Then, adding 3 g of anionic surfactant (Neogen RK, manufactured by Daiichi Kogyo Seiyaku Co., Ltd.) to the dispersion containing the agglomerated particles, the stainless steel flask is sealed, and heated to 97° C. with continuing stirring using a magnetic seal, which is maintained for four hours.

After cooling, the particle sizes are measured with a Coulter counter and a particle size of 5.1 μm is confirmed.

After filtering off the toner particles, the toner particles are washed with ion exchange water three times. Then, they are dispersed in ion-exchange water, and are adjusted to a pH of 10.0 with 1N sodium hydroxide and are kept at 80° C. for two hours in a round stainless steel flask. Then the toner particles are washed with ion exchange water three times, dried in a vacuum for 10 hours, and sieved to obtain a toner.

The electrical conductance of the toner is 17 μS/cm, and the surface tension is 48 mN. In addition, the dielectric loss factor is 16.

Comparative Example

A toner liquid is prepared in the same manner as described in Example 1.

The toner particles are filtered off from the prepared toner particle-containing liquid, and are washed with ion exchange water three times.

Then the toner particles are filtered off, washed with ion exchange water three times, dried in a vacuum for 10 hours, and sieved to obtain a toner having an average particle diameter of 5.0 μm.

The electrical conductance of the toner is 115 μS/cm, the surface tension is 18 mN, and dielectric loss factor is 120.

The toners obtained in Examples 1 to 3 and the toner obtained in the Comparative Example, are each used to prepare developers for electrostatic charge image, and various developer properties are determined.

First, each toner is mixed with a carrier using a V type blender to prepare a developer for electrostatic charge image. As the carrier, acryl-coated carrier (average particle diameter: 80 μm, manufactured by Fuji Xerox Co., Ltd.) is used and mixed to provide a toner concentration of 5%. The developer for electrostatic charge image is put into a copying machine (Able 1302 Modifier MC, manufactured by Fuji Xerox Co., Ltd.). After evaluating the initial charging property, developing property, and transfer property under the environment of Azone (28° C., 90 RH %), a running test of 50,000 sheets is carried out, and the same evaluations of charging property, developing property and transfer property are conducted.

<Charging Property>

The charging property is determined by the degree of decrease of the charging amount of a developer on a magnetic roll, which is determined using a blow-off traibo determining device (manufactured by Toshiba Chemical Co., Ltd.). The results are demonstrated in the TABLE below and are represented as follows:

○ . . . change is 5 μc/g or less

Δ . . . change is more than 5 μc/g and less than 10 μc/g x . . . change is 10 μc/g or more <Transfer Property>

The transfer property is determined by transferring a solid image (Reflection density ID=0.7) on a photosensitive body with tape and conducting an organoleptic examination. These results are also demonstrated in the TABLE below and are represented as follows:

○ . . . uniform and fine

Δ . . . slightly non-uniform although it is insignificant in practical use x . . . significantly non-uniform <Developing Property>

The developing property is carried out by determining reflection density of a solid sample on a chart. The developing property is determined based on the degree of the decrease. These results are also demonstrated in the TABLE below and are represented as follows:

○ . . . change is 0.15 or less

Δ . . . change is more than 0.15 and less than 0.3 x . . . change is 0.3 or more

TABLE

| | | | | Charging Stability (High Temperature, High Humidity) | | Developing Property Reflection | | | | |
|---|---|---|---|---|---|---|---|---|---|---|
| | Electrical Conductance (μS) | Surface Tension (mN) | Dielectric Loss Factor | Tribo (Initial/ 50,000 Sheets) | Judgment | Density (Initial/ 50,000 Sheets) | Judgment | Transfer Property | Transfer Efficiency | Defects |
| Example 1 | 15 | 50 | 15 | −25/−22 | ○ | 1.48/1.41 | ○ | ○ | 95 | |
| Example 2 | 20 | 40 | 20 | −23/−19 | ○ | 1.49/1.42 | ○ | ○ | 94 | |
| Example 3 | 17 | 48 | 16 | −26/−23 | ○ | 1.45/1.40 | ○ | ○ | 96 | |
| Comparative Example | 115 | 18 | 120 | −26.7/−15 | Δ | 1.30/1.09 | X | X | 85 | Density decreased from 5000 Sheets |

It is clear from the TABLE that the developer for electrostatic charge image of the present invention is excellent in charging property, developing property and transfer property, and that these properties are maintained after a long-period of use (50,000 sheets). In addition, the TABLE demonstrates that the transfer efficiency of the developer of the present invention is high.

As described above, with the toner for developing an electrostatic charge image of the present invention, the dielectric loss factor is low, such as 100 or less, and dielectric property is excellent. In addition, the transfer efficiency is high. Further, since the developer for electrostatic charge image using the toner of the present invention can maintain extremely fine charging property in any environment, the toner provides a high transfer efficiency, which is a particular merit for a toner prepared by a wet process, fine transfer property, and high quality image excellent in small-line reproducibility without image fault.

What is claimed is:

1. A toner for developing an electrostatic charge image, said toner being prepared by a wet-process in which toner particles comprising resin are granulated in water, an organic solvent, or a mixture of water and an organic solvent, wherein the toner particles have a dielectric loss factor of 100 or less.

2. A toner for developing an electrostatic charge image according to claim 1, wherein a solution of the toner particles formed by dissolving the toner particles in an organic solvent and mixing with deionized water has an electrical conductance of 101 $\mu$S or less and surface tension of 20 mN or more.

3. A toner for developing an electrostatic charge image according to claim 1, wherein the toner particles are prepared by agglomerating and/or associating resin particles and a colorant in a dispersion in which the resin particles and the colorant are dispersed with stirring to granulate.

4. A toner for developing an electrostatic charge image according to claim 1, wherein the toner particles have a toner shape factor average (square of a perimeter/projected area) of from 105 to 150.

5. A toner for developing an electrostatic charge image according to claim 1, wherein the toner is formed by heating the toner particles after granulation to the glass-transition temperature (Tg) or higher of said resin.

6. A toner for developing an electrostatic charge image according to claim 3, wherein the resin particles have an average particle diameter of 1 $\mu$m or less.

7. A toner for developing an electrostatic charge image according to claim 3, wherein the toner particles contain release agent fine particles.

8. A toner for developing an electrostatic charge image according to claim 3, wherein the resin particles and/or the colorant are added stepwise during the process in which the resin fine particles and the colorant are agglomerated and/or associated.

9. A method of preparing a toner for developing an electrostatic charge image, comprising granulating a dispersion in which resin particles are dispersed to form toner particles, and, after granulation heating the toner particles to the glass transition temperature (Tg) or higher of the resin.

10. A method of preparing a toner for developing an electrostatic charge image according to claim 9, wherein after granulation the dispersion containing the toner particles is adjusted to a pH 7 to 12 and stirred.

11. A method of preparing a toner for developing an electrostatic charge image according to claim 9, wherein after heating to said Tg or higher the toner particles are dispersed in water and the dispersion is stirred.

12. A method of preparing a toner for developing an electrostatic charge image according to claim 9, wherein the toner particles are heated to a temperature 10 to 35° C. higher than Tg.

13. A method of preparing a toner for developing an electrostatic charge image according to claim 9, wherein said dispersion further comprises a colorant and a stabilizing agent.

14. A method of preparing a toner for developing an electrostatic charge image according to claim 9, said method comprising dispersing resin particles to form an agglomerated particle dispersion containing agglomerated resin particles; adding a fine particle dispersion containing fine particles to the agglomerated particle dispersion and mixing, to adhere the fine particles to the agglomerated particles forming adhered particles; and heating and fusing the adhered particles.

15. A method of preparing a toner for developing an electrostatic charge image according to claim 14, wherein said fine particles are release agent fine particles.

16. A method of preparing a toner for developing an electrostatic charge image according to claim 14, wherein said fine particles are colorant fine particles.

17. A developer for electrostatic charge image comprising a carrier for electrophotography and a toner for developing an electrostatic charge image, wherein the toner for developing an electrostatic charge image is a toner according to claim 1.

18. A developer for electrostatic charge image according to claim 17, wherein the carrier for electrophotography has a resin-coated layer.

19. A image forming method comprising forming a latent image on an electrostatic latent image holding member, developing the electrostatic latent image on the electrostatic latent image holding member using a developer according to claim 17 on a developer carrying member, transferring a toner image on the latent image holding member to a transfer body, and removing toner remaining on the latent image holding member.

20. A image forming method according to claim 19, wherein the method further comprises transferring the toner for electrostatic charge image removed from the latent image holding member to the developer layer.

21. A method for preparing a toner developing an electrostatic charge image, comprising:

granulating a dispersion in which particles, a colorant and a stabilizing agent are dispersed to form toner particles, after granulation, washing the toner particles with water to remove stabilizing agent from the toner particles, heating the washed toner particles to the glass transition temperature (Tg) or higher of the resin, and after heating, washing the toner particles with water to remove additional stabilizing agent from the toner particles.

22. A toner for developing an electrostatic charge image according to claim 1, wherein the toner particles have a dielectric loss factor of 50 or less.

* * * * *